United States Patent [19]

Kuo

[11] Patent Number: 4,987,753

[45] Date of Patent: Jan. 29, 1991

[54] PADLOCK

[76] Inventor: Wen T. Kuo, No. 16, Lane 459, Sec. 1, An Ho Road., Tainan, Taiwan

[21] Appl. No.: 446,697

[22] Filed: Dec. 6, 1989

[51] Int. Cl.[5] ..... E05B 9/04

[52] U.S. Cl. ..... 70/39; 70/41; 70/46

[58] Field of Search ..... 70/41–47, 70/32, 39

[56] References Cited

U.S. PATENT DOCUMENTS

| | | | |
|---|---|---|---|
| 956,007 | 4/1910 | Weeks | 70/43 |
| 1,005,852 | 10/1911 | Lewis | 70/43 |
| 1,347,467 | 7/1920 | Scott et al. | 70/32 X |
| 1,667,254 | 4/1928 | Hedrich | 70/46 |
| 4,545,224 | 10/1985 | Zane | 70/39 |
| 4,730,470 | 3/1988 | Zane et al. | 70/41 X |

FOREIGN PATENT DOCUMENTS

| | | | |
|---|---|---|---|
| 561573 | 10/1923 | France | 70/41 |

*Primary Examiner*—Robert L. Wolfe
*Assistant Examiner*—Suzanne L. Dino
*Attorney, Agent, or Firm*—Morton J. Rosenberg; David I. Klein

[57] ABSTRACT

An improved padlock, and in particular, one having a lock body which has a pivot at one end and a lock mechanism at its other end, a shackle having two legs of equal length where one leg is connected to an elliptical connecting end and the other leg is connected to a notch.

1 Claim, 7 Drawing Sheets

PADLOCK

BACKGROUND AND PRIOR ART

The prior art of a padlock generally has a U-shaped lock and bolt 9 (shown as in FIG. 6) having unequal length legs. The longer of the two legs pierces through and protrudes the lock body 91 and the other leg of the U-shaped locking bolt 9 may be locked by protuberance 93 of a lock mechanism 92. Such a U-shaped locking bolt may be broken by force, and the lock is not easy to lock or unlock if the visibility is bad. Another kind of prior art has a rounded bow 8 (shown as in FIG. 7) which has two notches 81 at two ends. Both notches penetrate through and can be locked into two holes 82 of the lock body 89 which is a through bore and has an engaging member 84 and a lock mechanism 85 placed in the lock body 89. The lock body 89 has two openings 86 symmetrical with the two holes 82 of the lock body 89 and is controlled by a lock mechanism 85. However, if visibility is not good, the user may have difficulty placing the bow 8 into the two holes 82 of the lock body 89. In view of such shortcomings, therefore, the inventor has invented the present invention referred to as an improved padlock.

SUMMARY OF THE INVENTION

It is the primary object of this invention to provide an improved padlock which is easy to lock or unlock.

It is still another object of the present invention to provide an improved padlock which is more secure.

It is a further object of the present invention to provide an improved padlock which is economical to produce.

DETAILED DESCRIPTION OF THE PREFERRED EMBODIMENT

Figure 1:
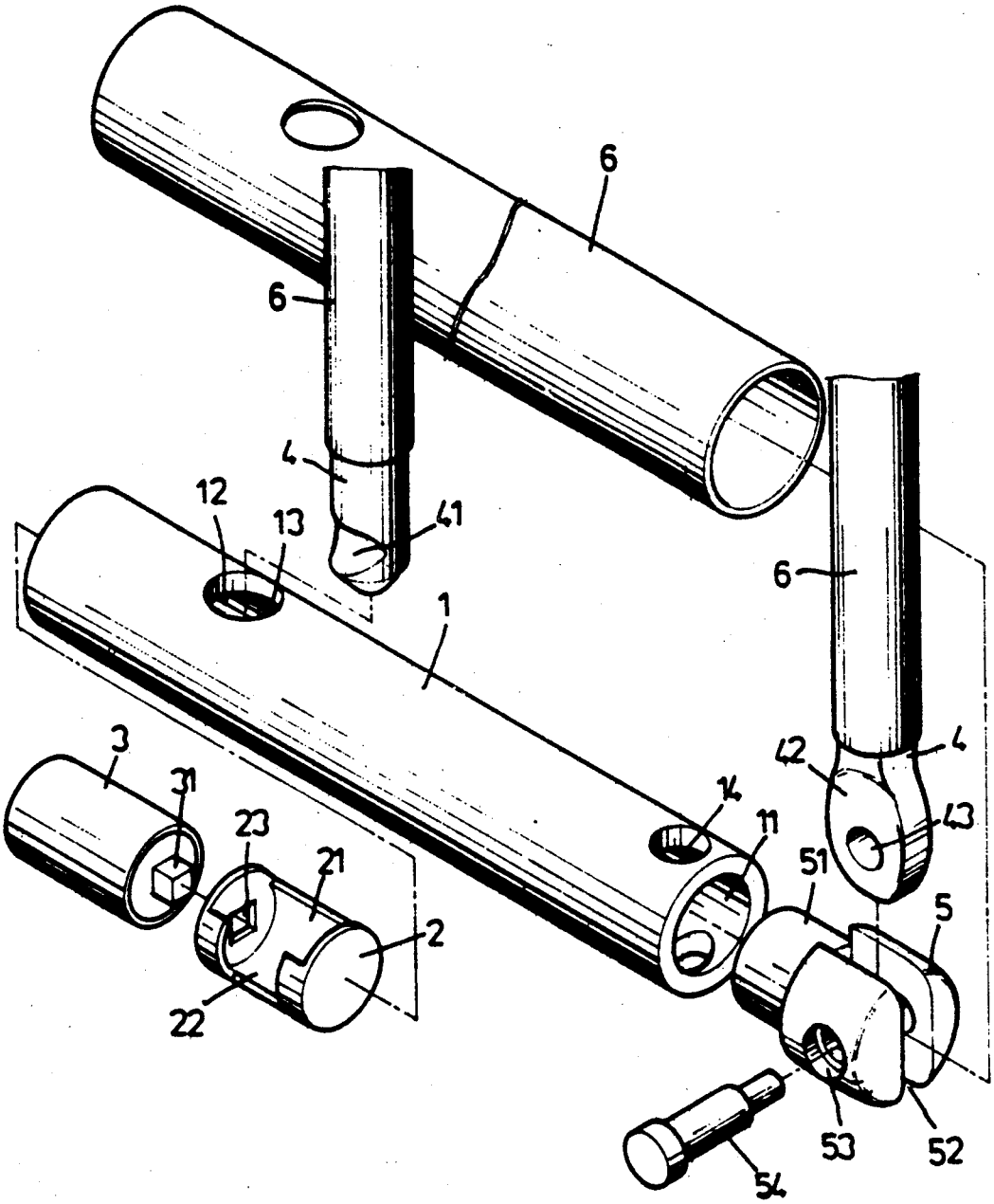
FIG. 1 is a breakdown view of the present invention.
Figure 2:
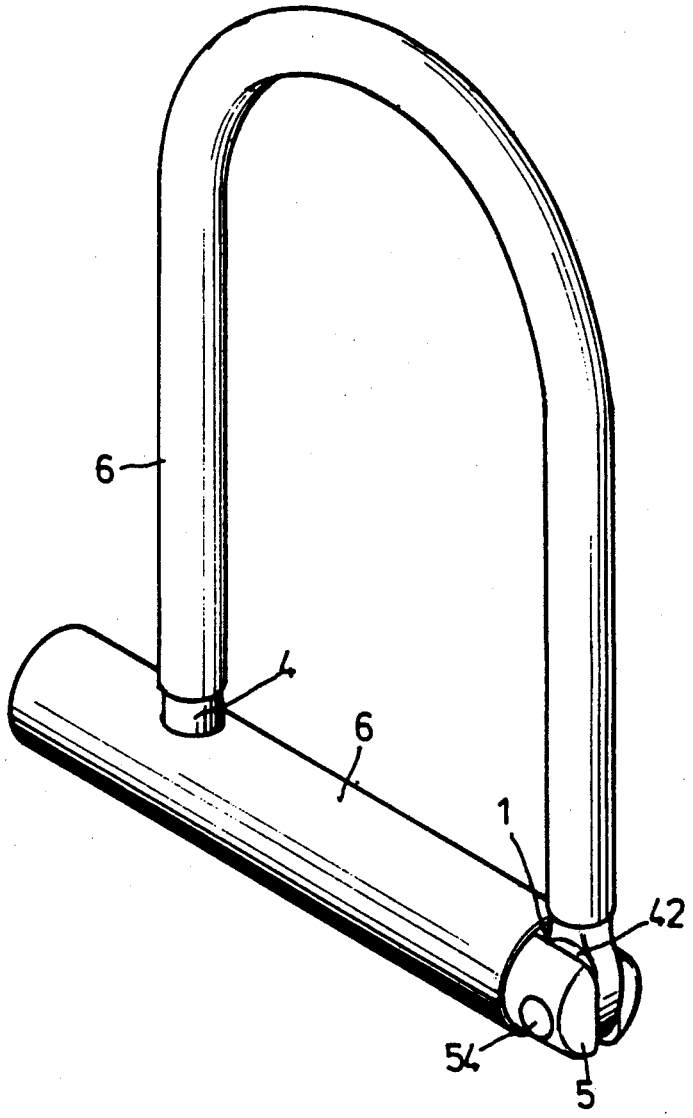
FIG. 2 is a perspective view of the present invention.

Reference is now made to the Drawings and in particular to FIG. 1, thereof, which comprises a round bar of metal or shackle 4, which is bent to a U-shape to provide two legs, a lock body 1, and a cover 6. Said shackle 4 has a notch 41 at one end and an elliptically contoured connecting end 42, and a connecting hole 43 at the other end. The lock body 1 has a through bore 11 with one end connected with a pivot 5, a hole 12 on top of the lock body 1, and a lock mechanism 3 at the other end of the lock body 1. The elliptically contoured connecting end 42 of the shackle 4 is connected with the pivot 5. The hole 43 is in symmetrical alignment with two pivot holes 53 of the pivot 5, and then fixed with a rivet 54. The pivot 5 has a fixture 51 which is to be placed under lock body 1 and fixed with the welding process (plug welds) through a hole 14 of the lock body 1. The other leg of the shackle 4 is to be placed into the hole 12 of lock body 1. The hole 12 is defined by an inclined wall 13 having a larger diameter on an exterior wall of the lock body 1 when taken with respect to an internal wall of the lock body 1, which allows for easy insertion of notch 41 of the shackle 4. The notch 41 is locked in place by the engaging member 2. A chamber 21 has an opening 22 on one side and a square hole 23 on the other side. When a responsive key is inserted into the lock mechanism 3 to rotate the cubic lug 31, which is engaged with the square hole 23 of engaging member 2, the engaging member 2 will be forced to rotate therewith and the notch 41 of the shackle 4 may either be locked or unlocked (shown as in FIG. 2).

Figure 3:
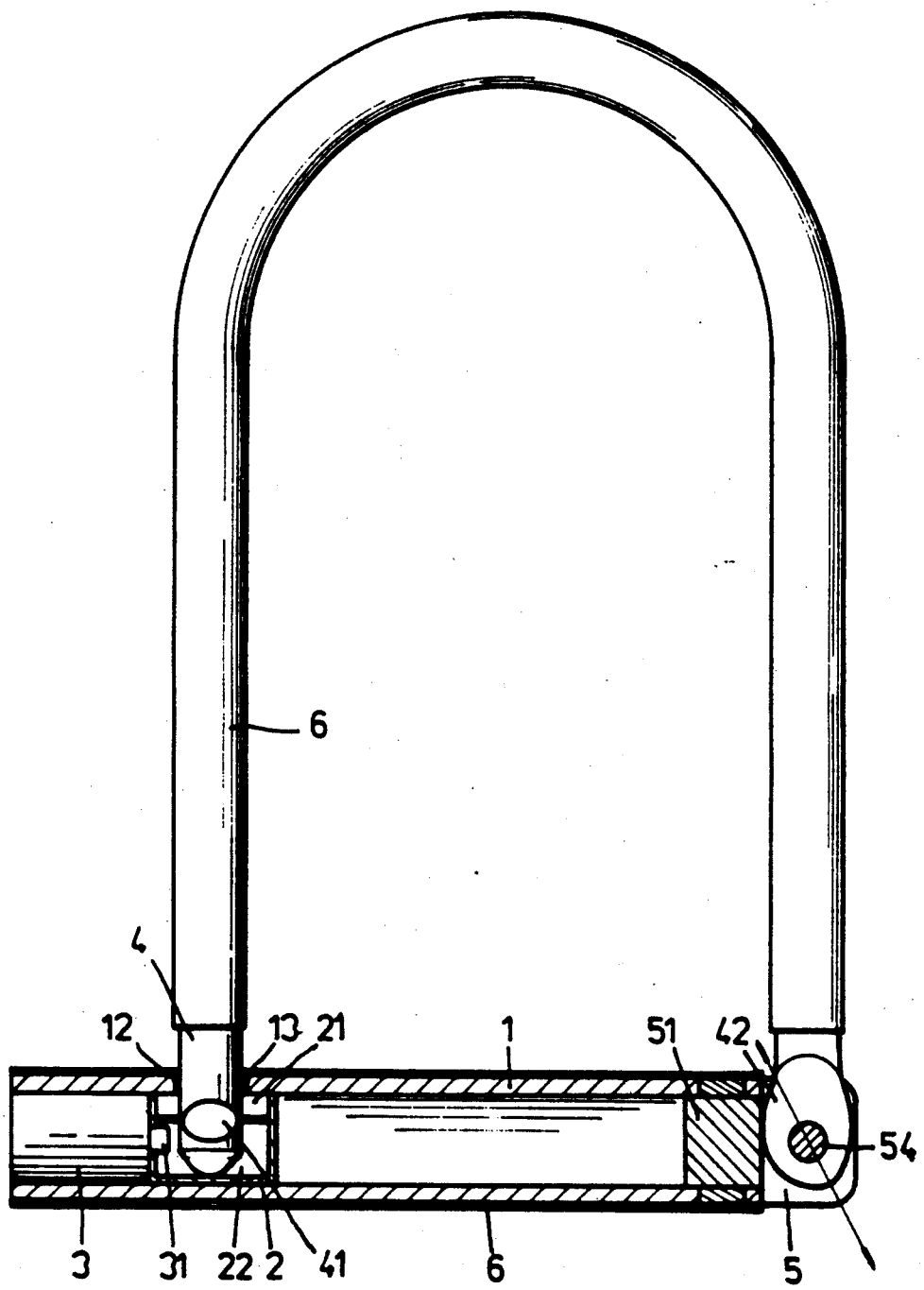
FIG. 3 is a cross-sectional view of the present invention.
Figure 4:
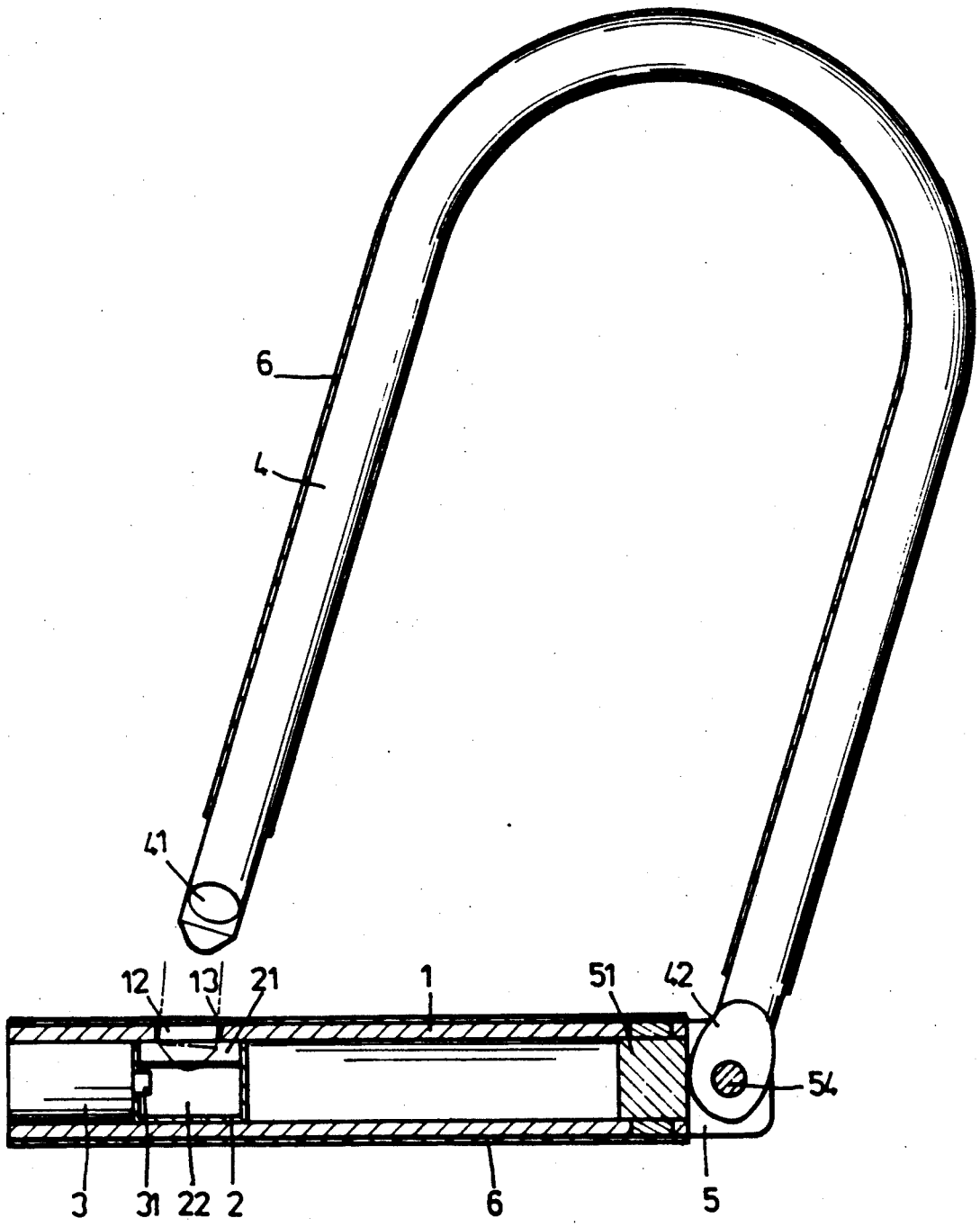
FIG. 4 is another cross-sectional view of the present invention.

FIG. 3 is a cross-sectional view of the present invention which shows that the notch 41 has been locked by the opening 22 of the chamber 21 of the engaging member 2. By inserting a responsive key and rotating the lock mechanism 3, the engaging member 2 will be forced to rotate again and the opening 22 of the chamber 21 of engaging member 2 will release the notch 41 of shackle 4. Furthermore, because one leg of shackle 4 has an elliptically contoured connecting end 42 in an arcuate manner that is connected with the pivot 5, the shackle 4 while remaining in rotation coupling with the pivot 5 allows the other leg of the shackle 4 to be inserted into the hole 12 of the lock body 1. The inclined wall 13 allows notch 41 of the shackle 4 to be easily passed through hole 12 and locked by the engaging member 2.

Figure 5:
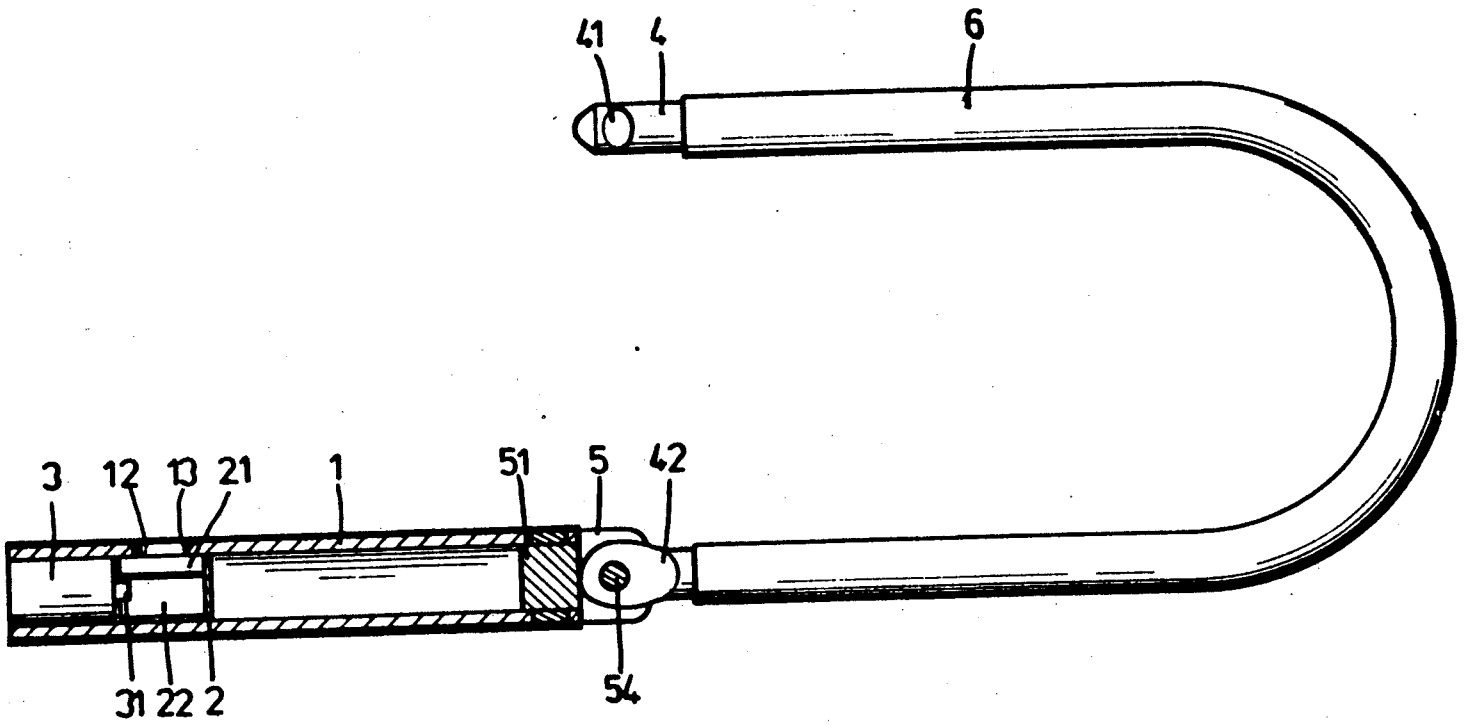
FIG. 5 is a further cross-sectional view of the present invention.
Figure 6:
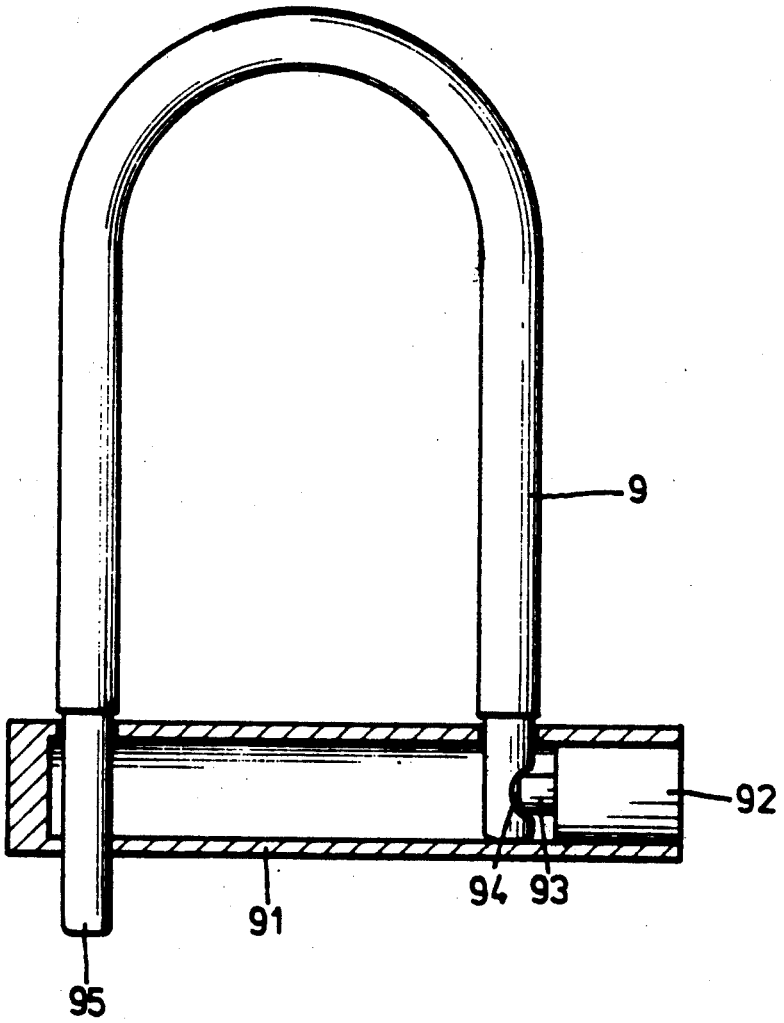
prior art FIG.6
FIGS. 6 and 7 are two prior arts.
Figure 7:
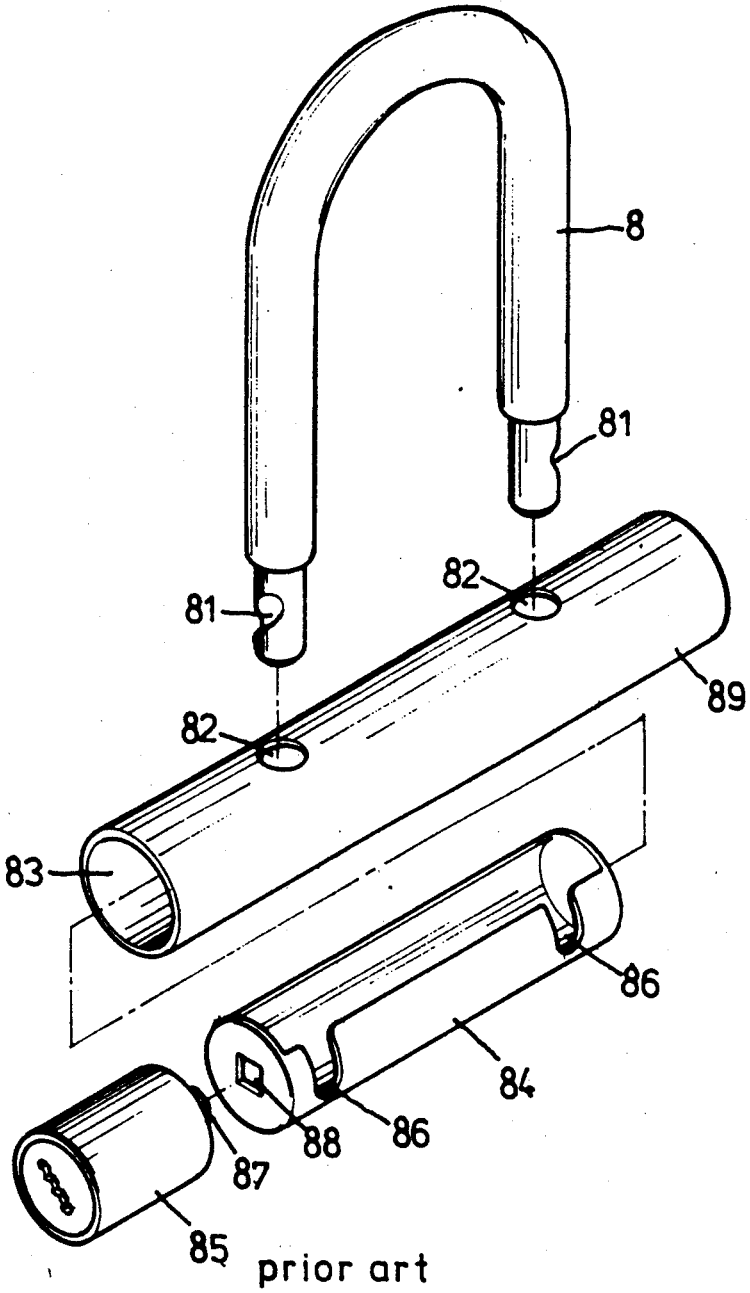
prior art FIG. 7

One third of the elliptical connecting end 42 of shackle 4 (shown as in FIG. 3) interfaces with the wall of the trough 52 when the shackle 4 is rotated. The radius from the center of the hole 43 to the outer side wall of the connecting end 42 shall not be larger than the radius from the hole 53 to the outer wall of the fixture 51 of pivot 5. Thus, the bow or shackle 4 may be moved when it is unlocked. Furthermore, the radius from the center of the hole 43 to the outer bottom wall is slightly larger than the distance from the center of the hole 53 to the outer wall of the fixture 51 of pivot 5, so that the shackle 4 is fitted snugly against the wall of fixture 51 when the shackle 4 is opened, as shown in FIG. 5. It should also be appreciated that the slant 13 of hole 12 will lead the notch 41 of the shackle 4 into hole 12.

I claim:

1. An improved padlock comprising:

a lock body having a through opening defining a through bore, said lock body having opposite ends for removable insert of a lock mechanism within one end and a pivot member fixedly insertable within the other end, said lock body including an inclined wall through opening;

a U-shaped shackle member having opposing legs of equal length, one of said legs being insertable within said inclined wall opening, and said other leg being rotatably mounted on said pivot member external said lock body;

an engaging member insertable within said lock body through opening and rotatable with respect to said lock body, said engaging member being rotatable into capturing relation with one of said legs of said shackle member having a notch formed therein, said engaging member having a square hole for passing therethrough of a lug member mounted on said locking mechanism, said other leg of said shackle being elliptically contoured for contacting a wall of said pivot member when said shackle is opened through a predetermined angle.

* * * * *